US005269257A

United States Patent [19]

Yamazaki

[11] Patent Number: 5,269,257

[45] Date of Patent: Dec. 14, 1993

[54] METHOD AND APPARATUS FOR SEWING TAPE IN A SEWING MACHINE

[75] Inventor: Toru Yamazaki, Osaka, Japan

[73] Assignee: Pegasus Sewing Machine Mfg., Ltd., Osaka, Japan

[21] Appl. No.: 918,457

[22] Filed: Jul. 22, 1992

[30] Foreign Application Priority Data

Jul. 25, 1991 [JP] Japan ..... 3-186463

[51] Int. Cl.[5] ..... D05B 35/06; D05B 35/10; D05B 19/00

[52] U.S. Cl. ..... 112/262.2; 112/262.3; 112/306; 112/121.26; 112/121.11; D05B/35/06; D05B/35/10; D05B/19/00

[58] Field of Search ..... 112/121.26, 121.27, 112/305, 306, 152, 153, 130, 121.11, 272, 63, 262.1, 262.2, 262.3, 265.1

[56] References Cited

U.S. PATENT DOCUMENTS 4,038,931 8/1977 Kosrow et al. ..... 112/272
4,455,954 6/1984 Franck, III et al. ..... 112/306 X
4,635,575 1/1987 Schips ..... 112/121.26
4,714,036 12/1987 Raisin et al. ..... 112/121.27
4,967,674 11/1990 Rohr et al. ..... 112/121.26
5,054,409 10/1991 Schips ..... 112/306

*Primary Examiner*—Peter Nerbun
*Attorney, Agent, or Firm*—Flynn, Thiel, Boutell & Tanis

[57] ABSTRACT

A method and apparatus is disclosed for attaching a continuous tape to a circular edge of a tubular workpiece with a sewing machine, and cutting the tape so that an overlapping length of the tape tail end on the sewing front portion of the tape is of a uniform length for various kinds of workpieces without changing the preset conditions.

The apparatus has a stitch counter, a tape cutter and a thickness detecting sensor of the light transmission type for detecting the presence or absence of thick materials in front a presser foot 2. In the tape sewing process, when the sewing front end makes a full turn and reaches the thickness detecting sensor and this sensor detects that the quantity of transmitted light is lower than a specific level, the stitch counter begins to count the number of stitches, and when the low level continues over a specific number of stitches, the tape cutter is actuated.

4 Claims, 5 Drawing Sheets

METHOD AND APPARATUS FOR SEWING TAPE IN A SEWING MACHINE

BACKGROUND OF THE INVENTION

1. Field of the Invention

The invention relates to a method and apparatus for attaching a continuous tape in a sewing machine to a circular edge of tubular workpiece such as the waist portion of a swimsuit or a brief, and automatically cutting the tape when the front and rear ends of the tape are overlap by a certain amount after the front end makes a full turn around the circular edge.

2. Description of the Prior Art

As a method for automatically cutting off the continuous tape when the front and rear ends of the tape overlap by a certain amount after the front end of the tape makes a full turn, a method is known for setting the number of sewing stitches preliminarily depending on the size of the tape attaching portion of the tubular workpiece, counting the number of stitches from the start of sewing, and driving the cutter when the number reaches the set value to cut off the tape.

In a flat workpiece, as a method for attaching a tape, a method is known for starting the counting of the number of stitches when the rear end of the workpiece is detected by an end detecting sensor disposed before a presser foot of the sewing machine, and cutting off the tape by driving the cutter when reaching a predetermined number of stitches.

In the conventional method of attaching a tape to a tubular workpiece, since the start of counting of the number of stitches is based on the start of sewing, even a small difference in every stitch between the feed amount of the workpiece and tape is accumulated during the sewing operation, and considerable variations occur in the overlapping amount of the tape at the end of sewing between sewn products. To prevent defects due to shortages of tape length, it is necessary to set the number of stitches somewhat larger, which gives rise to increased costs and impaired comfort of wearing or appearance of the sewn products.

When sewing products differing in properties in the workpiece or tape, or size or type of the tape sewing portion of the workpiece, the setting of the number of stitches must be changed every time, which is very bothersome.

The method of cutting the tape when the number of stitches reaches a preset number by detecting the cloth end cannot be directly applied to an endless tubular workpiece.

SUMMARY OF THE INVENTION

An object of the invention is to solve the problems of the above mentioned disadvantages in the prior art for tape attaching method and apparatus. In the invention, the overlapped amount of the tape tail end part on the sewing start part of the tape may be uniform in various workpieces, regardless of the properties of the workpieces or tape and size of the tape attaching portion of the tubular workpieces, and it is not necessary to change the setting if the type of product varies.

The invention presents a method and an apparatus for attaching a continuous tape in a sewing machine to the circular edge of a tubular workpiece. The apparatus has a tape feed roller disposed above a presser foot and a tape cutter at the delivery side of the roller, for feeding and sewing a tape released from the tape feed roller onto the tubular workpiece beneath the presser foot and cutting the tape at a proper length before the presser foot.

A light transmission type thickness detecting sensor, disposed before the presser foot, detects if the light transmission quantity through the tape and workpiece is below a specific level. A stitch counter counts the number of stitches after the thick detecting sensor detects a low level of light transmission while driving the sewing machine.

A control device actuates the cutter when the number of stitches reaches a specified number of counts.

The thick detecting sensor of the invention similarly detects some thick portions, such as the seam on two plies of workpieces, but the length of such thick portions are not very long and the quantity of transmitted light returns to the normal level before the number of stitches reach the specified number, so that it may be distinguished from a continuous thick part, such as the sewn tape. By detecting the sewing front end at a specific position before the presser foot and actuating the cutter after a specific number of stitches automatically, the overlap length of the tape tail end part on the sewing start end part may be uniform, without fluctuations, regardless of the properties the workpiece or tape, or size of the tape sewing portion of the tubular workpiece, as long as the stitch pitch is constant, and it is not necessary to change the setting of the number of stitches.

A lateral feed roll for feeding the workpiece in a direction orthogonal to the feed direction, a detecting sensor for detecting the side edge of the workpiece, and control device for controlling the rotation in a normal or reverse direction of the lateral feed roll by a signal from the detecting sensor, and an air blow pipe for pressing the side edge on the lateral feed roll by blowing air thereon serve to prevent the dislocation of the workpiece and to attach the tape on the proper portion of the workpiece.

EMBODIMENT

Figure 1:
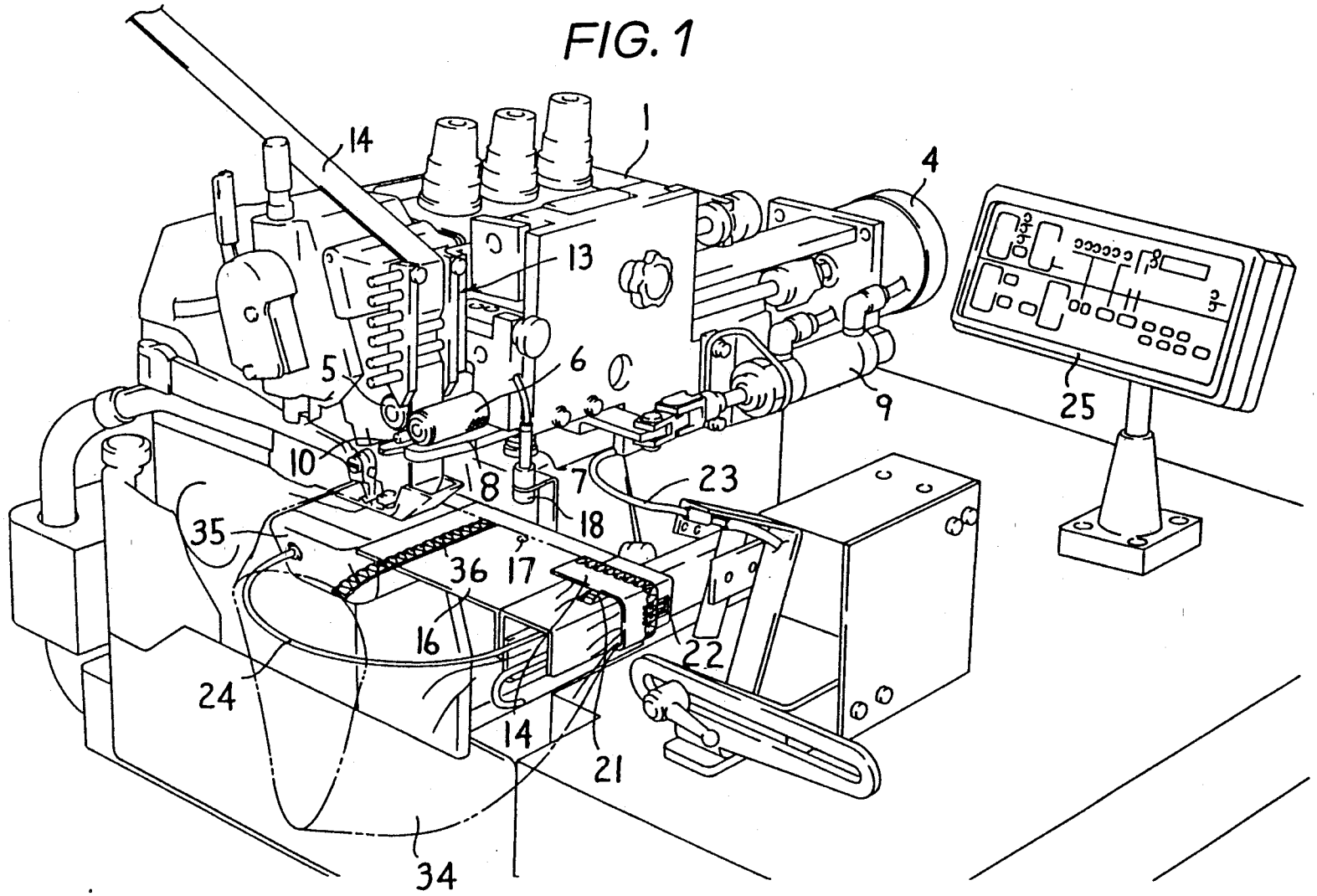
FIG. 1 is a perspective view of a cylinder bed type overlock sewing machine having a tape sewing apparatus of the invention.

The FIG. 1 shows an apparatus for attaching a continuous elastic tape in a sewing machine to a circular edge of a tubular workpiece 34, such as the waist portion of a swimsuit or a brief.

A tape insertion guide 3 is attached to the front end of a presser foot 2 of an overlock sewing machine 1, and a tape feed device comprises a feed roller 5 rotated and driven by a motor 4 and a holding roller 6 is disposed thereabove. At the lower end of the tape feed device, there is a cutting device comprising a fixed knife 8, and a movable knife 10 biased to the fixed knife by a spring 7. The movable knife 10 is opened and closed by an air cylinder 9. At the upper side of the tape feed device, a tension applying device 13 planting multiple parallel pins 12 is disposed. An elastic tape 14 fed from a reel(not shown) meanders among the pins 12 of the tension applying device, passes between the rollers 5 and 6, and further runs between the fixed knife 8 and movable knife 10, and is inserted into the tape insertion guide 3 so as to be fed beneath the presser foot.

In front of the pressr foot 2 is disposed a light transmission type thick detecting sensor consisting of a light receiver 17 exposed from a tiny hole provided in a cloth plate 16 and a light transmitter 18 provided above it. This sensor detects the presence of thick cloth when the quantity of transmitted light becomes lower than a specific level, and the presence of thick cloth is not detected when the cloth conveyed above the cloth plate is thin and the quantity of transmitted light is large, that is, when the quantity of light received by the light receiver 17 is large, but the presence of thick cloth is detected when the cloth is thick due to a seam, a stepped two-ply part or the cloth overlaps.

The cloth plate 16 has a lateral feed roller 21 for feeding the cloth in a direction orthogonal to the feed direction, and a cloth edge detecting sensor 22 disposed at the front side of the light receiver 17. An air blow pipe 23 is provided at one side on the cloth plate 16 for directing an air flow onto the side edge of the workpiece 34 to help position the workpiece. The lateral feed roller 21, detecting sensor 22 and air blow pipe 23 compose a cloth edge control device.

The lateral feed roller 21 has a part of its peripheral surface exposed on the cloth plate 16, and is designed to be rotated in a normal or reverse direction orthogonal to the cloth feed direction by a step motor (not shown).

The detecting sensor 22 is a reflection type sensor having detecting portions disposed at both sides across a cloth edge guide line in a window disposed in the cloth plate 16 before the lateral feed roller 21. When the cloth covers both detecting portions, the upper surface of the lateral feed roller 21 rotates to the left in FIG. 1, and when both detecting portions are uncovered, it rotates to the right side in FIG. 1. Accordingly the cloth edge pressed to the upper surface of the lateral feed roller by the air blown down from the air blow pipe 23 is moved to the right or left, thereby controlling the cloth side edge may to a position between both detecting portions.

Figure 2:
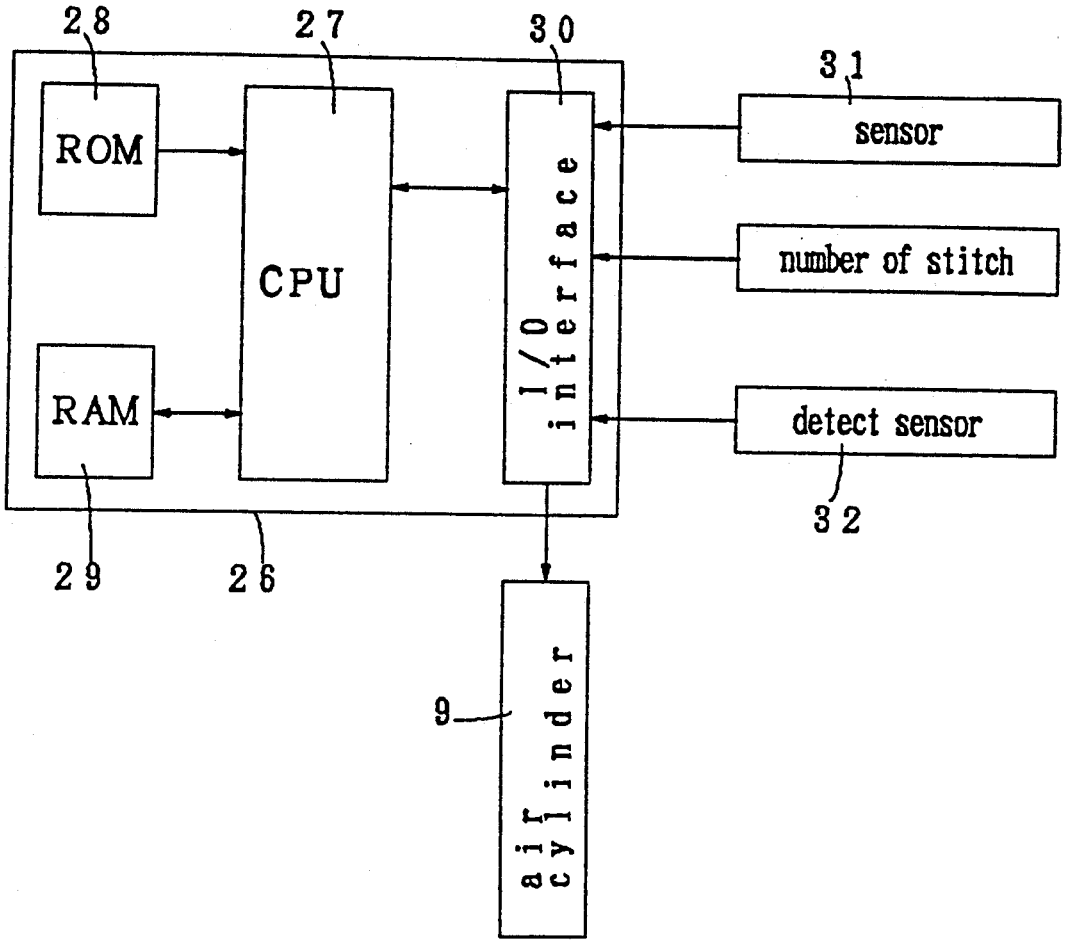
FIG. 2 is a block diagram of a control device.

In FIG. 1, numeral 24 is a cloth support frame, and 25 is an operation panel, in which a microcomputer 26 as shown in FIG. 2 is incorporated. The microcomputer is composed of a CPU 27 as the means for operation, comparison and control, a ROM 28 storing control programs for controlling the cutting device, a RAM 29 for storing the control data, and an I/O interface 30, and a desired number of stitches $P_N$ is entered in the CPU 27 through the I/O interface 30 by key operation on the operation panel 25, and stored in the RAM 29. It is desired to set $P_N$ in a range of 5 to 7, which may be increased or decreased if necessary.

The CPU 27 also receives a detection signal transmitted from a sewing machine revolution sensor 31 as the stitch counting detecting means every time the pulley of the sewing machine rotates, that is, by detecting every stitch, and presence or absence of thick cloth detected by a thick cloth detecting sensor 32 through the I/O interface. The CPU 27 starts counting the number of stitches detected by the sewing machine revolution sensor 31 right after the thick cloth detecting sensor 32 detects the presence of thick cloth, and judges that the front end of the elastic tape 14 has passed when the counting reaches the present number of stitches read out from the RAM 29, and issues a control signal to the air cylinder 9 at the same time or a specified time later, and actuates the movable knife 10 to cut the elastic tape 14 passing between it and the fixed knife 8 in collaboration of the fixed knife 8.

Figure 3:
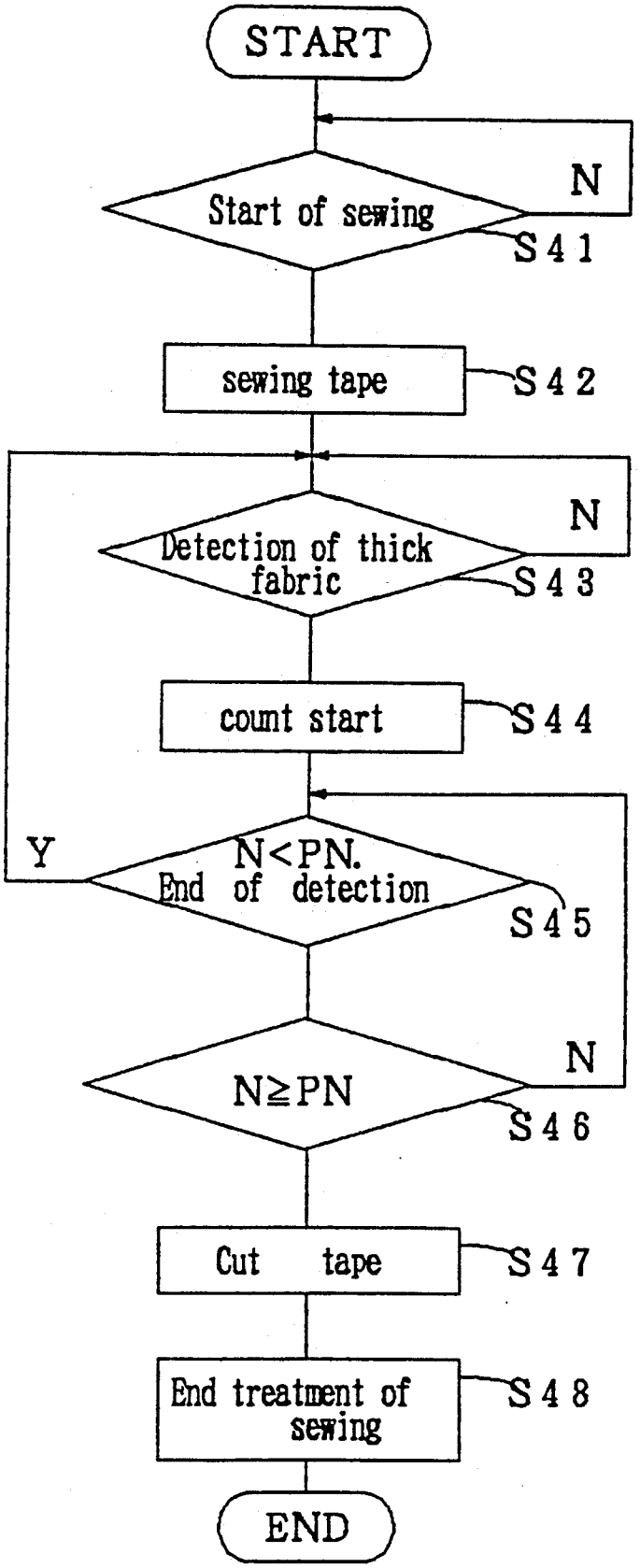
FIG. 3 is a flow chart for sewing the tape.

The operations of the embodiment of the invention is described below while referring to the flow chart in FIG. 3.

Figure 4:
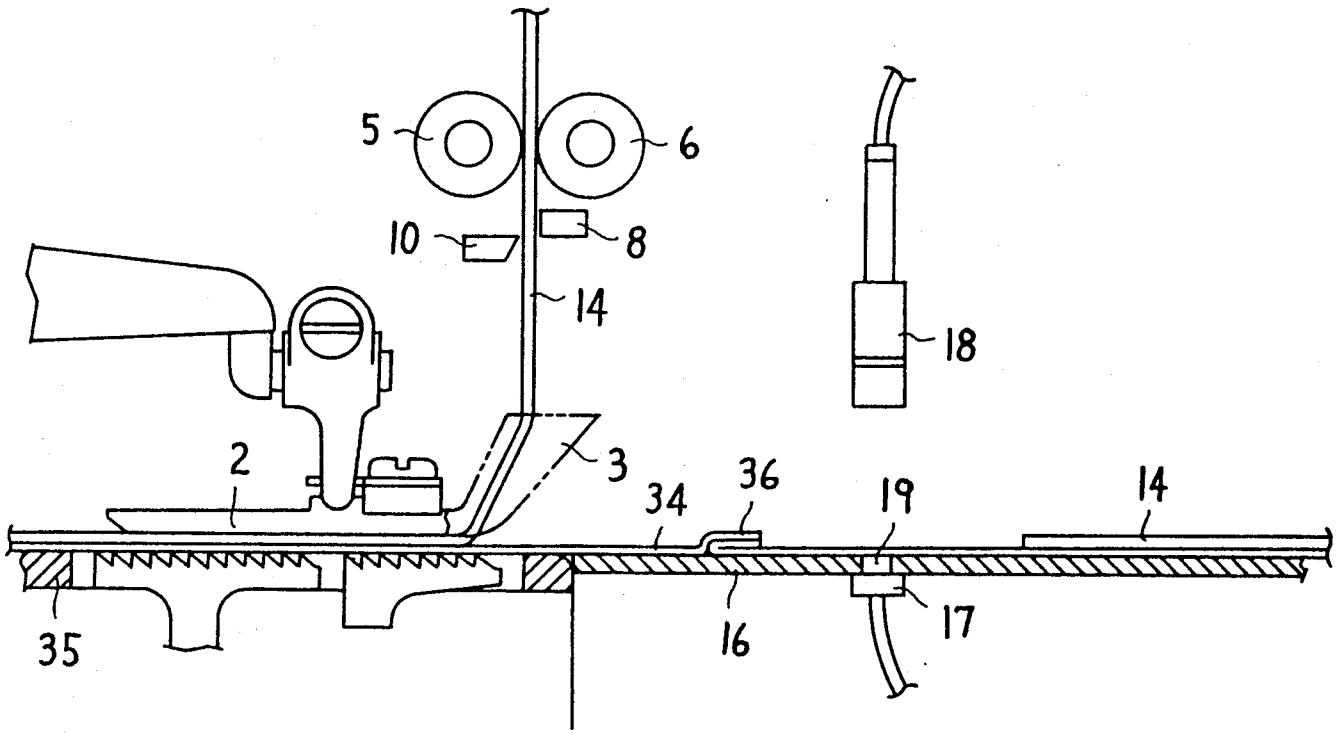
FIG. 4 is a partial enlarged sectional view of the sewing section in FIG. 1 and shows the front end of the tape attached on the workpiece which turns around the circular edge of the workpiece and reaches under the detecting sensor.
Figure 5:
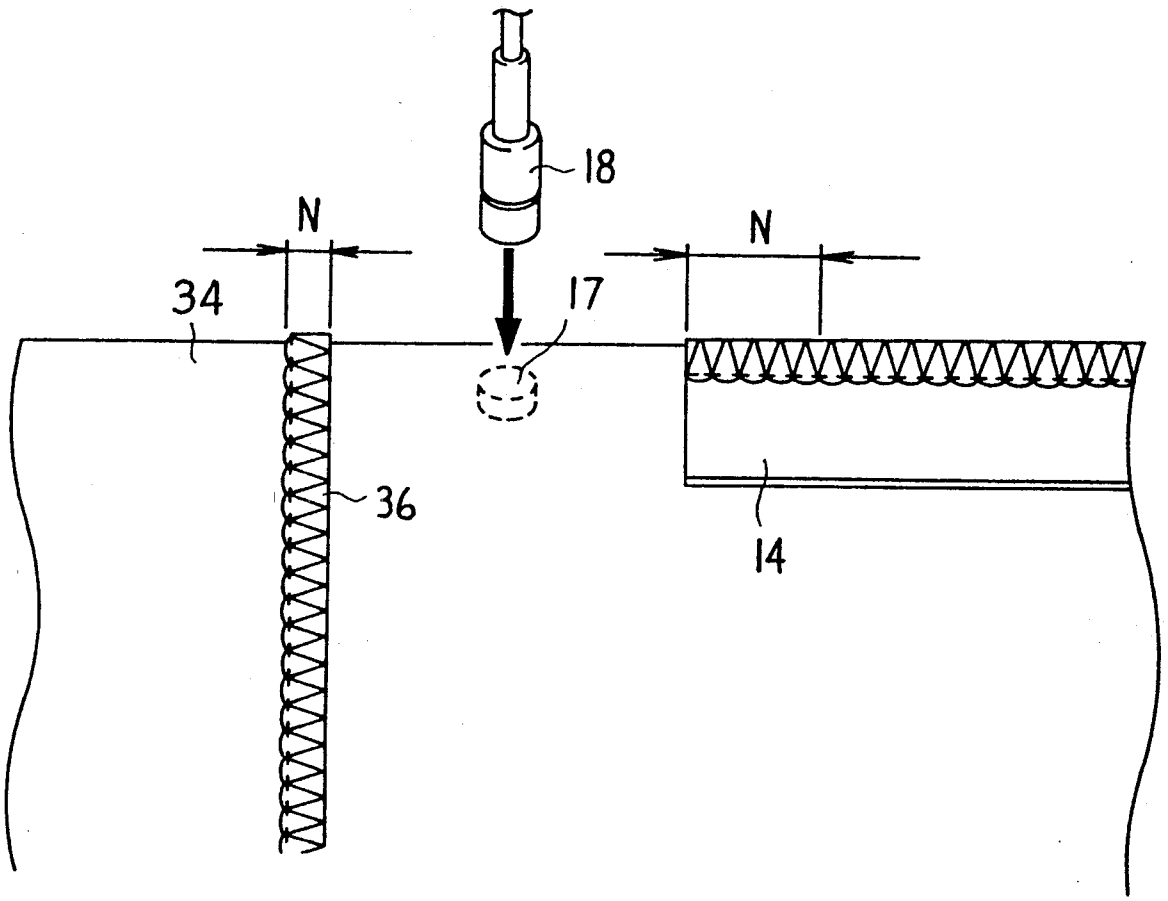
FIG. 5 is a perspective view of the front end of the tape attached on the workpiece which turns around the circular edge of the workpiece and reaches under the detecting sensor.

A tubular workpiece 34 is put on a cloth support frame 24, and inserted between the presser foot 2 and cloth plate 16 of a cylinder bed 35 (then, the presser foot 2 is lifted). After positioning the workpiece 34 roughly, the elastic tape 14 is inserted into the insertion guide 3, and pushed beneath the presser foot. Later, the presser foot 2 is lowered, and the sewing machine 1 is started (step 41). Accordingly, as shown in FIG. 1, the tape 14 is sewn along the circular edge of the workpiece 34 (step 42). In the process of sewing, as shown in FIG. 4 and FIG. 5, when the thick detecting sensor 32 detects a thick portion with two or more plies of the workpiece at a spliced part 36 (step 43), the counting of the number of stitches is started (step 44). But if the thick portion is short, such as at the spliced part 36, the sensor 32 detects a thin portion before the counted number of stitches N reaches the preset number $P_N$(step 45). Then the sewing machine works continuously, and the counted number is canceled. After a full turn of the tubular cloth 34, when the thick detecting sensor 32 detects the front end of the sewn elastic tape 14, the counting of the number of stitches begins again. Afterwards, when the counting reaches the preset number of stitches $P_N$(step 46), it is judged that the elastic tape 14, not the spliced part 36, that is, the front end of the elastic tape has made a full turn, and a control signal is sent to the air cylinder 9. Accordingly, the movable knife 10 is put in action, immediately or after a specific number of stitches, to cut the elastic tape 14 (step 47). In this way, the sewing tail end portion is overlaps on the sewing front portion by a specific length, for example, 10 mm. After the sewing process (step 48), the sewing machine stops.

This overlap length may be determined by the number of stitches from the detection of the start of tape until the actuation of the movable knife.

What is claimed is:

1. A method of sewing a tape on a circular edge region of a tubular workpiece comprising the steps of:

providing a sewing machine with a horizontally disposed bed on which said tubular workpiece is supported;

providing a presser foot of said sewing machine above said bed;

positioning said circular edge region of said tubular workpiece between said presser foot and said bed;

feeding said tape onto said circular edge region positioned between said presser foot and said bed;

stitching said tape onto said circular edge region;

providing a cloth thickness detection means in front of said presser foot, said cloth thickness detection means comprising a light transmitter for transmitting a light through said circular edge region and a light receiver for detecting the quantity of light transmitted through the circular edge region;

providing a stitch counter for counting stitches in said circular edge region;

activating said stitch counter when said cloth thickness detection means determines that said circular edge region is of at least a particular thickness;

deactivating said stitch counter when said cloth thickness detection means determines that said circular edge region is not of at least said particular thickness for a first particular number of stitch counts;

providing a tape cutter for cutting said tape; and activating said tape cutter when said stitch counter counts a second particular number of stitch counts in said circular edge region, said second particular number of stitch counts being greater than said first particular number of stitch counts.

2. The method of claim 1, additionally comprising the steps of:

feeding the circular edge region of said tubular workpiece in a direction orthogonal to the feed direction with a lateral feed roll;

detecting the edge of said circular edge region with a sensor;

pressing the edge of said circular edge region to the lateral feed roll by air flow from an air blow pipe; and controlling the direction of rotation of said lateral feed roll in response to a signal from said sensor.

3. A sewing machine for sewing a tape on a circular edge region of a tubular workpiece, said sewing machine comprising:

a horizontally disposed bed on which said tubular workpiece is supported;

a presser foot provided above said bed;

a tape feed roller for feeding a continuous tape onto said circular edge region on said tubular workpiece when said circular edge region is positioned between said bed and said presser foot, said tape feed roller being provided above said presser foot and having a tape delivery side facing said bed;

a tape cutter located between said tape delivery side and said bed;

cloth thickness detection means provided in front of said presser foot, said cloth thickness detection means comprising a light transmitter for transmitting a light through said circular edge region and a light receiver for detecting the quantity of light transmitted through the circular edge region;

a stitch counter for counting stitches in said circular edge region;

means for activating said stitch counter when said cloth thickness detection means determines that said circular edge region is of at least a particular thickness;

means for deactivating said stitch counter when said cloth thickness detection means determines that said circular edge region is not of at least said particular thickness for a first particular number of stitch counts; and means for activating said tape cutter when said stitch counter counts a second particular number of stitch counts in said circular edge region, said second particular number of stitch counts being greater than said first particular number of stitch counts.

4. The sewing machine of claim 3, additionally comprising a lateral feed roll for feeding the circular edge region of said tubular workpiece in a direction orthogonal to the feed direction, a sensor for detecting the edge of said circular edge region, an air blow pipe for directing an air flow onto said edge of said circular edge region and press it to the lateral feed roll, and a controller for controlling the direction of rotation of said lateral feed roll in response to a signal from said sensor.

* * * * *